United States Patent [19]

Dobrzanski

[11] Patent Number: 4,654,644

[45] Date of Patent: Mar. 31, 1987

[54] PHOTOELECTRIC SMOKE DETECTOR CIRCUITRY

[75] Inventor: John J. Dobrzanski, New Britain, Conn.

[73] Assignee: General Signal Corporation, Stamford, Conn.

[21] Appl. No.: 720,441

[22] Filed: Apr. 5, 1985

[51] Int. Cl.[4] ..... G08B 17/10

[52] U.S. Cl. ..... 340/630; 250/574; 356/439

[58] Field of Search ..... 340/628, 630, 629; 250/573, 574, 575; 356/438, 439

[56] References Cited

U.S. PATENT DOCUMENTS 4,186,390 1/1980 Enemark ..... 340/630

4,506,161 3/1985 Muggli et al. ..... 250/574

*Primary Examiner*—James L. Rowland

*Assistant Examiner*—Daniel Myer

*Attorney, Agent, or Firm*—Robert R. Hubbard; Milton E. Kleinman; Ronald Reichman

[57] ABSTRACT

A photoelectric smoke detector operating on a scattered light principle. The photosensor is connected at the input of an operational amplifier, such amplifier functioning as a threshold detector, saturation pulse amplifier and fixed pulse width compensator. Another feature of the invention resides in the provision of a special RC network connected from the output of a first transistor of a flasher section or subcircuit, which provides pulse power to the light source, to the input of a second transistor in such flasher circuit. As a consequence of this arrangement, when the LED serving as the light source tends to age, with a corresponding increase in its impedance, an appropriate signal is fed back from the aforenoted output of the first transistor to the input of the second, thereby to increase the pulse width of the output signal through the LED such that it is no longer, thereby compensating for the fact that it is no longer as bright.

7 Claims, 1 Drawing Figure

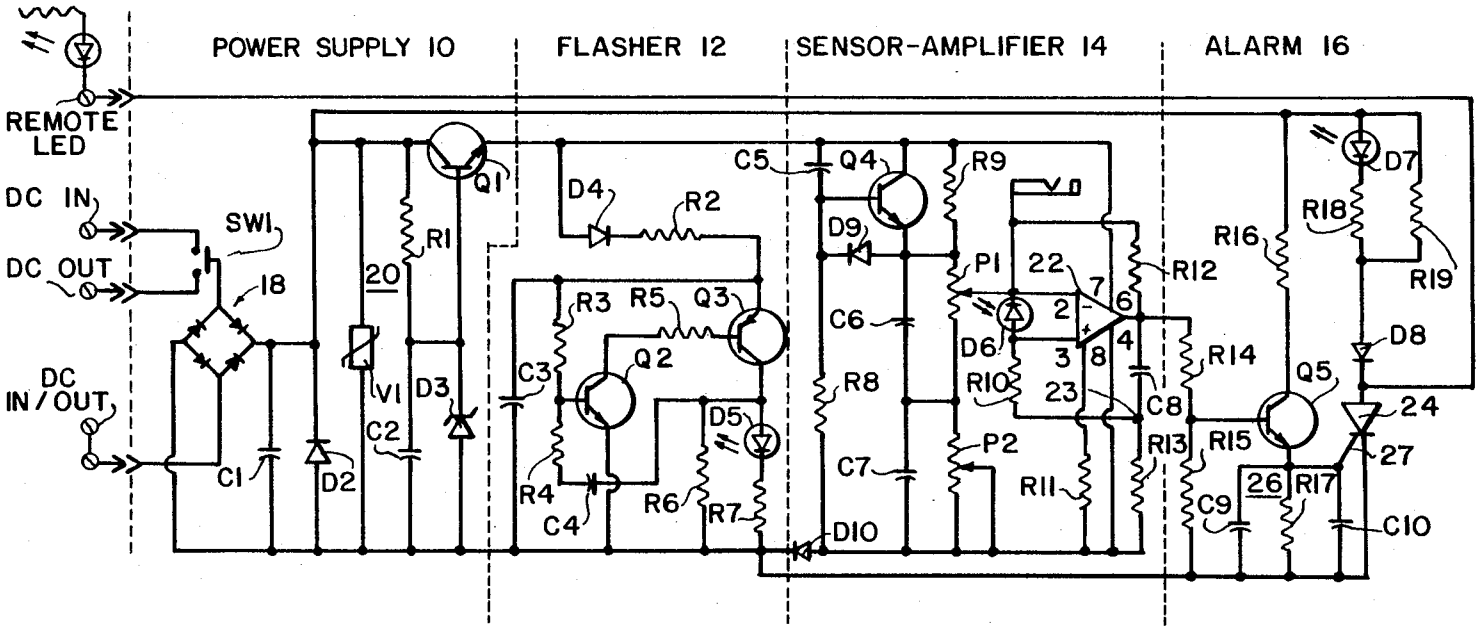
ALARM 16
SENSOR-AMPLIFIER 14
FLASHER 12
POWER SUPPLY 10
REMOTE LED
DC IN
DC OUT
DC IN/OUT
SW1
18
C1
D2
20
V1
C2
D3
R1
Q1
C3
R4
C4
R3
R5
Q2
Q3
R6
R7
D5
D4
R2
C5
Q4
D9
C6
R8
C7
D10
R9
P1
D6
R10
P2
R11
22
2
3
23
7
6
4
8
R12
C8
R13
R14
R15
C9
26
R17
Q5
R16
R18
D7
R19
D8
24
27
C10

PHOTOELECTRIC SMOKE DETECTOR CIRCUITRY

BACKGROUND OF THE INVENTION

1. Field of the Invention

This invention relates to a photoelectric smoke detector and more particularly to such a detector operable based on the scattered light principle. In accordance with this principle light from a suitable source is not directly impinged upon a sensor device. Instead the sensor is placed at an angle to the light beam and is normally unilluminated. However, when smoke particles enter a smoke sensing chamber the smoke particles or the like interrupt the light beam and result in scattering light onto the sensor. Light scattering intensity is a function of the light wave length from the light source, typically a light emitting diode (LED); it is also a function of the particle density, size and composition.

2. Background Information

The present invention resides in improvements in the specific context of the electronics or circuitry involved in a photoelectric smoke detector of the type described. This improved circuitry is also found in a detector device described in related application Ser. No. 720,440, filed Apr. 5, 1985, assigned to the assignee of the present invention.

In order to provide background material so that the complete context and the various features and advantages of the present invention will be thoroughly appreciated, reference may be made to the following U.S. Pat. Nos.: 4,163,969; 4,186,390; and 4,193,069.

All of the above cited references involve optical or photoelectric smoke detectors operating on the scattered light principle and having a flashing or clock-pulsed light source. These referenced patents appear to be concerned with the problem resulting from the presence of transient voltage surges in the power lines, or electromagnetic voltage surges induced in the smoke detector, and other electrical interference or spurious illumination that spuriously simulates the photo cell's response to smoke scattered light pulses. Each of these patents takes a somewhat different approach to the problem, but they all appear to include as part of the solution a coincident logic scheme which is directed to rendering it unlikely that spurious signals will coincidentally occur with the flashes or pulses of illumination from the light source.

SUMMARY OF THE INVENTION

Whatever the objects, features and advantages of the references cited hereinabove, such references are not directed to achieving the precise objects that are fulfilled by the present invention.

It will be appreciated that the context of the present invention, that is the field of photoelectric smoke detectors, requires that the detector devices be manufactured at a very low cost and at the same time that they be able to provide extremely high amplification because of the very small signals involved. Thus, a light sensor in the form of a photodiode, as used in the detector in which the present invention is incorporated, "sees" only one millionth of the light intensity being put out by the light source in the form of a light emitting diode.

Accordingly, it becomes a major object of the present invention to provide a low cost solution to the problem of utilizing only a single operational amplifier to amplify the electrical signal put out by the photodiode; and yet to enable the preclusion or inhibition of transient signals due to noise or the like, such transient signals sometimes being referred to as sliver signals, because they are extremely short in duration (i.e., they have a narrow pulse width).

A primary feature of the present invention resides in the provision of an operational amplifier uniquely capable of functioning as a threshold detector, saturation pulse-amplifier and fixed pulse width compensator. Such operational amplifier has a high input impedance, of the order of megohms, which is compatible with the impedance of the photodiode. The photodiode is pulsed on for approximately 100 microseconds and off for a period of 5 seconds by smoke reflection, if present in the chamber. The photodiode is arranged to operate as a photovoltaic-cell that generates voltage wherever an infrared light source is detected.

Another primary feature of the invention relates to an arrangement which compensates for the aging process involved with the LED (Light Emitting Diode), which constitutes the light source for the photodetector. The LED is incorporated in a flasher or pulse generator circuit, such circuit comprising a pair of suitably interconnected transistors operating in a free running multivibrator mode. A feedback network, constituting the required means for automatically compensating for any increase in impedance of the LED due to aging, is connected such that it functions to increase the pulse width of te output signal of the flasher circuit. Consquently, curent pulses of longer duration are delivered to the LED tomake up or compensate for the ongoing increase in its impdance stemming from the aging process. The advantageous rsult is that substantially the same illumination is always provided by the LED.

Other and further objects, advantages and features of the present invention will be understood by reference to the following specification in conjunction with the annexed drawing, wherein like parts have been given like numbers.

BRIEF DESCRIPTION OF THE DRAWING

The FIGURE is a schematic diagram of the circuitry for the preferred embodiment of a photoelectric smoke detector, in which the features of the present invention have been incorporated.

DESCRIPTION OF PREFERRED EMBODIMENT

Before proceeding with a detailed description of the preferred embodiment of the present invention, it should be noted that the circuit aspects herein are related to the invention described and claimed in copending U.S. application Ser. No. 720,440, filed Apr. 5, 1985, assigned to the assignee of the present invention. The circuitry herein described is also found in that related application. The details of the invention disclosure of the copending application are herein included by reference.

The photoelectric smoke detector has, as fundamental components, a smoke sensing chamber and a photo-optics system based on the scattered light principle, whereby the photosensor in the form of a diode is not in line with the light beam but is, instead, placed at an angle such that it is normally non-illuminated. Smoke particles entering the smoke-sensing chamber, interrupt the light beam so as to scatter light on to the photosensor.

The light source, photodiode, as well as associated lensing, are packaged and selected for comparability in wave length and position. These elements are packaged in a chamber that restricts ambient light entry but readily permits smoke to enter. The photodiode is connected to respond as a photovoltaic device and as such, it is a voltage generator when light is applied onto its surface. The photodiode is connected to the input of an amplifier and is monitored for a threshold smoke-generated voltage.

Referring now to the FIGURE, the photoelectric smoke detector circuit shown therein can be divided into four basic sub-circuits or sections: the power supply 10 which includes a bridge and regulator; a flasher section 12, which is a basic multivibrator circuit; a sensor-amplifier section 14; and an alarm section 16.

The bridge 18 is used to permit non-polarized voltage inputs to the photodetector terminals seen at the left. The voltage regulator 20 provides regulation for a range of applied input voltages so as to enable a constant voltage to be applied to the flasher section 12 and the sensor-amplifier section 14. Voltage regulation to these sub-circuits is required to maintain a consistent smoke response. Otherwise a slight change in voltage would cause variation in the flasher timing and light intensity, and/or the amplifier setting and, therefore, the resultant amplification. The input to the regulator can be varied between 11 and 26 volts without affecting the required circuit operation.

The voltage regulator 20 includes the emitter follower regulator Q1 and a dropping resistor R1, which functions to limit current to a further included element, that is, a Zener diode D3. A varistor V1 is also included as part of the regulator circuit 20 for controlling and reducing high voltage transistors, while diode D2 is used to prevent UHF transmitter frequencies from entering into the circuitry by shortening line terminations.

The flasher sub-circuit 12 is designed to flash the light-emitting diode for a period of 100 microseconds repeated once every five seconds. The reason for flashing, or pulsing is to reduce the circuit current that would otherwise be excessive for multi-zone smoke detector operations involving up to fifty detectors connected to one zone.

The operational amplifier 22, which forms a part of the sensor-amplifier section 14, is designed as a high-gain, low current integrated circuit operational amplifier which functions to monitor a voltage threshold, which, when exceeded by the voltage generated by photodiode D6, creates regeneration in the detector amplifier circuit so as to initiate an alarm in the alarm section 16. This alarm sub-circuit has a latching device 24 in the form of an SCR, which is capable of maintaining the current requirements for alarming a control panel (not seen) by way of suitable zone wiring.

It will be appreciated that in the operation of the circuit of the present invention, the flasher sub-circuit 12 begins to operate as soon as power is applied to the detector. Base current begins to flow through resistors R3 into the base of transistor Q2. The collector current of transistor Q2 is the base current of transistor Q3. The resulting collector current of transistor Q3 divides between (1) the network consisting of the LED flasher designated D5 and its current limiting resistor R7, "porch removal" resistor R6 being connected in parallel therewith; and (2) the feedback path of resistor R4 and capacitor C4 in series. The feedback current adds to the base current of transistor Q2. The resulting positive feedback or regeneration causes saturation of transistor Q3, thereby causing D5 to turn on at full brilliance.

It will be understood that the feedback current begins to decay exponentially due to the resistor R4 and the capacitor C4 time constant (turn-on time). The flasher circuit begins to turn off when the current decays to a value that will not sustain saturation of transistor Q3. As transistor Q3 comes out of saturation, the voltage change is fed back to the base of transistor Q2, through the resistor R4 and capacitor C4 path. Regeneration occurs again, causing both transistors Q2 and Q3 to turn off rapidly. The charge on capacitor C4 is such that the base of transistor Q2 is made negative. Capacitor C4 begins to charge toward the regulator positive voltage through resistors R3 and R4 (turn off time). When the base of transistor Q2 reaches the transistor base-emitter "on" voltage, transistor Q2 begins to turn on, starting a new cycle. Capacitor C3 is used to sustain the turn-off on voltage applied to LED D5 and the feedback network at a constant level. When transistor Q3 turns on, capacitor C3 discharges through transistor Q3 and the LED network. Diode D4 is used to block out the discharge path of capacitor C3 through other paths for the remaining circuitry. Resistor R2 controls the charge time of capacitor C3, limiting the in-rush of line and regulator current.

The self-compensating feature of the present invention will now be described. It will be recalled that a typical LED such as D5 seen in the flasher section 12 is subject to an increase in impedance as the aging process takes place. However, precisely because the LED network is connected as seen in the FIGURE to the collector output of transistor Q3 and, further, because of the feedback path connection involving the capacitor C4 and resistor R4, the required automatic compensation is effectuated. What happens is that as the LED ages, with an accompanying impedance increase, the pulse width "on" time increases. This is accomplished by reason of the increase in potential at the junction of the anode of LED D5 and the collector of transistor Q3. The higher voltage is applied to the "on" time constant resistor R4 and capacitor C4 (regeneration feedback), causing it to increase the pulse width applied to D5. Thus, as the LED impedance is increased, its light level is decreased. However, the flasher circuit compensates for the light level decrease by increasing the "on" time pulse width for an increase in light duration. The repetition rate of 5 seconds "off" time is due to the time constant of capacitor C4 and resistors R3, R4, R7 and the LED (D5) impedance.

Turning now to the sensor-amplifier section 14, it will be seen that the photodiode D6 is connected in shunt across the inputs (minus input and plus input at pins 2 and 3 respectively of the differential operational amplifier 22). The voltage dividing network, consisting of resistor R9 and potentiometers P1 and P2, applies an adjustable positive potential to the input pin 2 of the operational amplifier 22 via the potentiometer P1 wiper. Potentiometer P2 is used to factory calibrate the threshold voltage limit applied to pin 2. Potentiometer P1 is used to field adjust the threshold voltage applied to pin 2 by the user. Resistors R10 and R13 have high resistance values (of the order of 20 megohms) and have a common node or junction 23. The other end of resistor R10 is connected to pin 3 of operational amplifier 22, while the other end of resistor R13 is connected to ground. This arrangement is required to prevent a floating input at pin 3.

The aforenoted high resistance values have been chosen for R10 and R13 so as not to load down the photodiode, thereby enabling its maximum detection response. Coupling capacitor C8 is connected between the aforesaid junction 23 of resistors R10 and R13 and pin 6 of operational amplifier 22. This junction 23 has been chosen so as not to load the photodiode, which would have an adverse effect on its sensitivity. Also, capacitor C8 has its value chosen with respect to its time constant with resistors R10 and R13.

The capacitor C8 feedback coupling will cause the operational amplifier output pin 6 to saturate whenever the set voltage threshold at pin 2 is exceeded by the operational amplifier pin 3 voltage, which excess generally corresponds with the voltage of the photodiode D6 when it is receiving scattered light. The time constant of capacitor C8 and resistors R10 and R13 are chosen to produce a desired pulse width output at operational amplifier pin 6, such pulse width being selected to be in the order of 4 to 5 milliseconds.

The saturated fixed pulse width output is so selected as to pulse the buffer amplifier, that is transistor Q5, into conduction. During the turn-on time of transistor Q5, the time constant of resistor R16 and capacitor C10 must charge capacitor C10 to a voltage level to cause the gate 27 of SCR24 to fire into conduction. This pulse width time constant of resistor R16 and capacitor C10 prevents a "sliver" or transient signal from firing the SCR into false conduction of said voltage source.

Referring now to the power supply end of the circuit seen in the FIGURE, it will be noted that power control switch SW1 is provided. This normally closed switch is opened when a smoke detector unit, as described in co-pending application (ED-233), has its grill removed from a cover member supplied as a part of the photodetector. Switch SW1 also affects a circuit, not seen, which causes operation of a trouble indicator at a central location when the grill of any one of a string or series of similar photodetectors, having corresponding switches, is unlatched from its cover, thereby causing opening of its switch SW1. At the same time, as will be appreciated, opening of switch SW1 removes power from the alarm circuit and thus prevents activation of a false alarm signal.

In order to provide a man skilled in the art with a detailed set of specifications relating to the components used in the circuitry of the present invention. The following table of values and types of components is included herewith.

| COMPONENT | VALUE OR TYPE |
|---|---|
| R1 | 1.8 megohm |
| R2 | 47 kilohm |
| R3 | 5.6 megohm |
| R4 | 12 ohm |
| R5 | 100 ohm |
| R6 | 22 kilohm |
| R7 | 4.7 ohm |
| R8 | 5.6 megohm |
| R9 | 1.2 megohm |
| R10 | 22 megohm |
| R11 | 10 megohm |
| R12 | 22 megohm |
| R13 | 22 megohm |
| R14 | 100 kilohm |
| R15 | 33 kilohm |
| R16 | 2.4 kilohm |
| R17 | 1 kilohm |
| R18 | 680 ohm (2 watt) |
| R19 | 680 ohm (2 watt) |

-continued

| COMPONENT | VALUE OR TYPE |
|---|---|
| C1 | .47 microfarads |
| C2 | 6.8 microfarads |
| C3 | 100 microfarads |
| C4 | 1.5 microfarads |
| C5 | .33 microfarads |
| C6 | .01 microfarads |
| C7 | .01 microfarads |
| C8 | 47 picofarads |
| C9 | .01 microfarads |
| C10 | 22 microfarads |
| D2 | IN4004 |
| D3 | IN5236 |
| D4 | IN4004 |
| D5 (LED) | OP2982 |
| D6 (photodiode) | 22BN18M |
| D7 (LED) | NSL5053 |
| D8 | IN4004 |
| V1 Varistor | D39ZA1 |
| 18 Diode Bridge | DIW02M |
| Q1 | 2N5088 |
| Q2 | 2N5088 |
| Q3 | 2N5366 |
| Q4 | 2N5088 |
| Q5 | 2N5088 |
| SCR24 | 2N5064 |
| 22 Operational Amplifier | LM4250CH |

NOTE:
Unless otherwise specified resistors are ¼ watt plus or minus 5%.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A photoelectric smoke detector circuit comprising:

a reference potential;

a light source;

pulse generator means for energizing said light source, said pulse generator means including at least first and second cross-coupled active devices, the first device being a pnp transistor and the second device a npn transistor, said light source being a light emitting diode connected directly to the collector of said pnp transistor;

means, connected between the output of said pnp transistor and the input of said npn transistor, for automatically compensating for an increase in impedance of said light source by increasing the width of the output pulse from said pulse generator means responsive to said impedance increase, whereby the amount of illumination from said light source remains substantially constant over time;

said means for automatically compensating including (1) a feedback path, having a capacitor and a first resistor connected in series between the output of said pnp transistor and the input of said npn transistor, and (2) a network having a second resistor connected in series with said light emitting diode, and a third resistor connected in parallel with said series-connected light emitting diode and said second resistor, the network being connected between the output of said pnp transistor and reference potential.

2. A detector circuit as defined in claim 1, in which a fourth resistor is connected between the base of said npn transistor and the emitter of said pnp transistor.

3. A detector circuit as defined in claim 2, in which a blocking diode and a fifth resistor are connected in series to said emitter of said npn transistor.

4. A photoelectric smoke detector circuit comprising:

a sensor amplifier including:

a reference potential;

a photosensor means, having an annode and a cathode, for generating electric pulses responsive to receive light pulses;

an operational amplifier, having first and second input terminals, for responding to said electric pulses generated by said photosensor means;

means for connecting said photosensor means across said first and second input terminals of said operational amplifier such that the cathode of said photosensor means is connected to said first terminal;

a voltage dividing network, including first and second potentiometers, the first potentiometer having a wiper connected to the cathode of said photosensor means and thereby to said first input terminal of said operational amplifier, the second potentiometer being connected to said first potentiometer for calibrating the threshold voltage applied to said first input terminal;

a junction at the output of said operational amplifier;

a stabilizing feedback network connected to said operational amplifier, said network including a first resistor connected between said second input terminal and said junction and a second resistor connected between said junction and said reference potential; and a capacitor connected between said output of said operational amplifier and said junction.

5. A circuit as defined in claim 4, in which said voltage dividing network further includes a third resistor connected to one end of said first potentiometer.

6. A circuit as defined in claim 4, further comprising:

an alarm circuit including a buffer amplifier connected to the output of said operational amplifier;

a silicon controlled rectifier device having its input connected to the output of said buffer amplifier, further including threshold means for preventing the silicon controlled rectifier from firing when spurious signals are present at its input.

7. A circuit a defined in claim 6, further including a light emitting diode, connected to the output of said silicon controlled rectifier device, for providing an alarm indication.

* * * * *